United States Patent [19]

Goi

[11] Patent Number: 4,605,217

[45] Date of Patent: Aug. 12, 1986

[54] BILL FEEDING APPARATUS

[75] Inventor: Kowichi Goi, Kawasaki, Japan

[73] Assignee: Laurel Bank Machine Co., Ltd., Tokyo, Japan

[21] Appl. No.: 720,286

[22] Filed: Apr. 4, 1985

[30] Foreign Application Priority Data

Apr. 6, 1984 [JP] Japan ..... 59-68552

[51] Int. Cl.[4] ..... B65H 3/52

[52] U.S. Cl. ..... 271/124; 271/263

[58] Field of Search ..... 271/121, 124, 125, 263

[56] References Cited

U.S. PATENT DOCUMENTS 3,986,712 10/1976 Hasegawa ..... 271/124

FOREIGN PATENT DOCUMENTS 111337 8/1980 Japan ..... 271/125

*Primary Examiner*—Richard A. Schacher

*Attorney, Agent, or Firm*—Fleit, Jacobson, Cohn & Price

[57] ABSTRACT

A feed-out roller and a friction member are disposed to form a gap therebetween, through which bills are fed out, one at a time. A gap adjusting mechanism is provided for changing the size of the gap by moving the friction member relative to the feed-out roller. A pressure sensor detects pressure acting on the friction member to generate a pressure signal. The gap is adjusted on the basis of the pressure signal.

5 Claims, 5 Drawing Figures

BILL FEEDING APPARATUS

BACKGROUND OF THE INVENTION

This invention relates to a bill feeding apparatus which separates and feeds bills, one at a time, from a stack of bills positioned in a bill handling machine such as a bill dispensing machine or a bill receiving machine.

In a conventional bill apparatus, as shown in FIG. 1, bills 3 stacked on a bottom plate 2 of a bill accommodating section 1 are fed out by a feed roller 4 in a planar direction of the bottom plate 2. The bills are caused to come into contact with a friction member 6 provided in the peripheral surface of a feed-out roller 5 and are pulled out, one at a time, from a feed-out port 7 due to frictional force generated between the bill and the friction member 6. Then, the bill thus pulled out is transferred into a transporting mechanism 10 through a gap 9 formed between the feed-out roller 5 and a friction block 8 provided along the outer periphery of the feed-out roller 5.

Furthermore, a friction member 11 similar to the friction member 6 of the feed-out roller 5 is provided inside the friction block 8. The friction member 11 functions to separate the bills 3 one by one between the feed-out roller 5 and the friction block 8 so as to prevent such malfunctioning as a double feed since frictional force in a direction opposite to the rotating direction of the feed-out roller 5 is generated to act on the bill 3.

In order to prevent a double feed and jamming in the gap 9, it is necessary to set the distance S of the gap (measured radially) between the feed-out roller 5 and the friction block 8 in such a way that the following formula will hold: $t<S<2t$ where t is the thickness of the bill. In reality, however, the bill varies in its thickness t, depending on whether the bill is new or has been circulated for a long time. Therefore, it is difficult to set the size of the gap 9 only from one viewpoint. Moreover, even if it is possible to once set the gap 9 at an appropriate dimension, the gap becomes larger as the friction members 6 and 11 are worn due to a repetition of feeding operations a large number of times. As a result, it becomes difficult to separate the bills, one by one.

SUMMARY OF THE INVENTION

It is, therefore, an object of the invention to provide a novel bill feeding apparatus which can precisely adjust the gap between a feed-out roller and a friction member of a friction block without being influenced by wear of the friction members.

In order to accomplish the above-mentioned object, the bill feeding apparatus according to the invention is constructed so that adjustment of the gap is made by detecting the contact pressure between the friction member and the feed-out roller by means of a pressure sensor and moving the friction member on the basis of the data obtained by the detection.

According to the present invention, there is provided a bill feeding apparatus which separates and feeds bills, one at a time, from a stack of bills positioned in a bill handling machine, and which comprises (a) a feed-out roller for feeding out the bills by engaging with one surface of the bills, (b) a friction member having a gap for the passage of bills between the friction member and the feedout roller and separating the bills, one at a time, by applying friction force to the other surface of the bills from the friction member, (c) a pressure sensor for detecting pressure acting on the friction member to generate a pressure signal, (d) a gap adjusting mechanism for adjusting the gap between the friction member and the feedout roller by moving the friction member, and (e) a control circuit for controlling the gap adjusting mechanism to adjust to gap on the basis of the pressure signal from the pressure sensor.

DESCRIPTION OF THE DRAWINGS

Other objects and advantages of the present invention will become apparent from the following description made with reference to the accompanying drawings, in which.

DESCRIPTION OF THE PREFERRED EMBODIMENT

Figure 1:
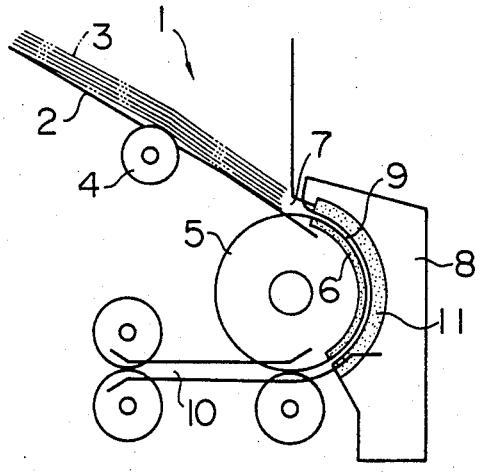
FIG. 1 PRIOR ART
FIG. 1 is a side view showing a conventional bill feeding apparatus.
Figure 2:
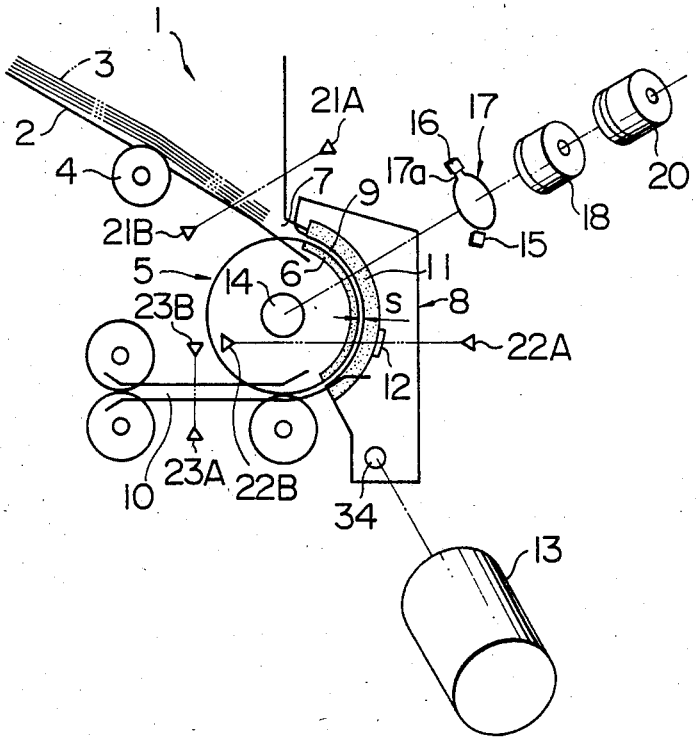
FIG. 2 is a side view showing one embodiment of a bill feeding apparatus according to the invention.

One embodiment of the present invention will be now described in detail with reference to FIGS. 2 to 4. In the figures, the same reference numerals are used for those parts that are substantially the same as those of a conventional bill feeding apparatus, and only a simple description will be made in respect of such parts.

In the embodiment of the bill feeding apparatus, a pressure sensor 12 is provided on the friction block 8 for detecting the pressure applied to the friction member 11 provided in the friction block 8. The detection signal issued from the pressure sensor 12 is adapted to be input to a gap adjusting unit 13 constituted by a pulse motor or the like at the time of gap adjustment or when an adjustment for the gap between the feed-out roller 5 and the friction member 11 is made, which will be described hereinafter in detail. The gap adjusting unit 13 adjusts the size S of the gap 9 between the friction block 8 and the feed-out roller 5 by causing the friction block 8 to rotate about its shaft 34. On the other hand, at the time of counting or when the bills 3 are separated and fed out to be counted, which will be described hereinafter in detail, the detection signal issued from the pressure sensor 12 is used to detect a double feed of bills 3, as shown in the control circuit of FIG. 3 and the flow chart of FIG. 4.

Furthermore, the shaft 14 of the feed-out roller 5 is provided with: a sensor actuating plate 17 having an actuator **17*a* for detecting the angle of rotation (posture) of the feed-out roller 5 by actuating a stop position detecting sensor 15 and an adjustment position detecting sensor 16 constituted by a photosensor or a magnetic sensor; an electromagnetic brake 18 for braking the shaft 14 to stop the same in a predetermined position; and an electromagnetic clutch 20 for establishing connection or disconnection between the shaft 14 and a feed motor 19 (see FIG. 3**), respectively.

Furthermore, the reference numerals 21A, 21B; 22A, 22B; and 23A, 23B indicate photosensors. They are, respectively, an accommodating-section residual bill detecting sensor for detecting the presence of bills inside the bill accommodating section 1, a separating-section residual bill detecting sensor for detecting whether or not any bill remains inside the gap 9, and a counting sensor for outputting a signal for counting the number of bills by counting up each time a bill is taken into the transporting mechanism 10.

Figure 3:
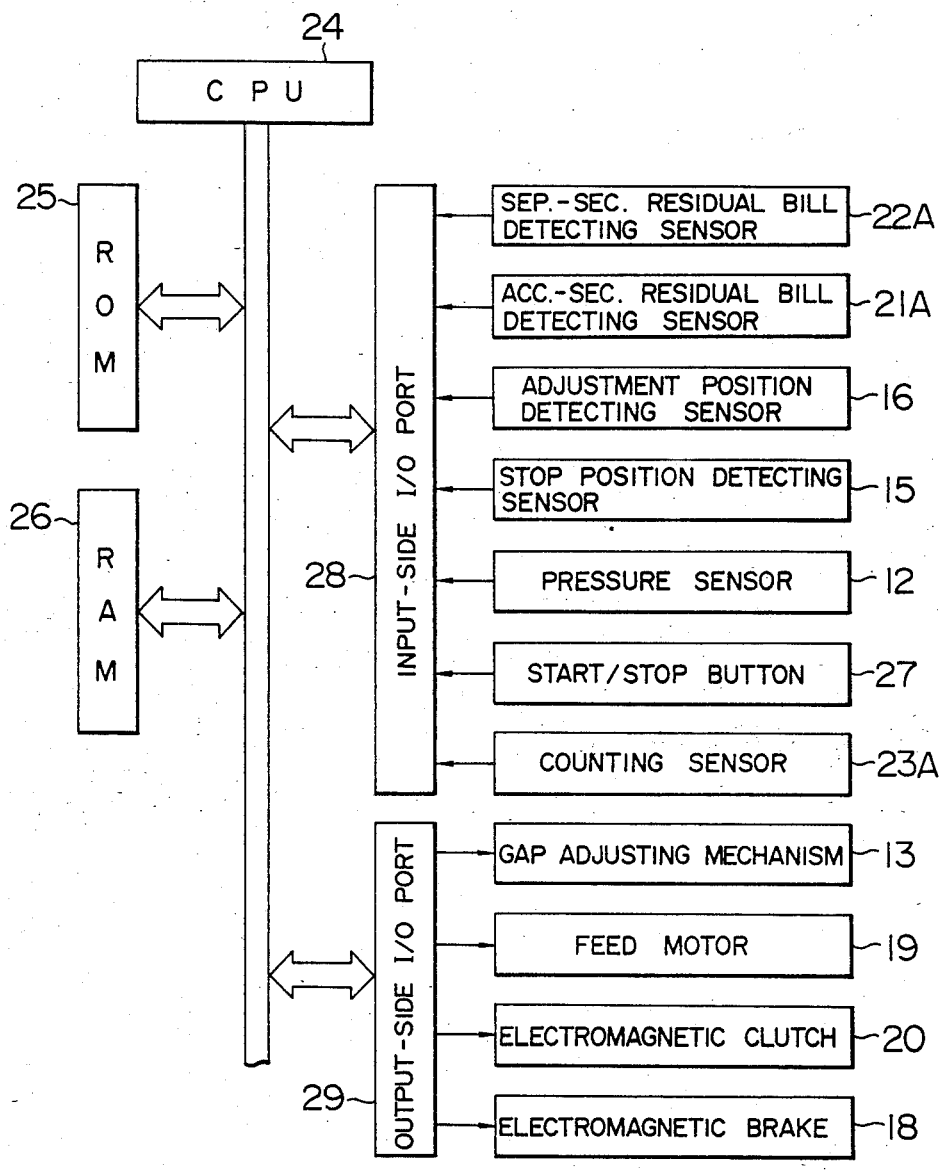
FIG. 3 is a block diagram of a control circuit for controlling the bill feeding apparatus.
Figure 4A:
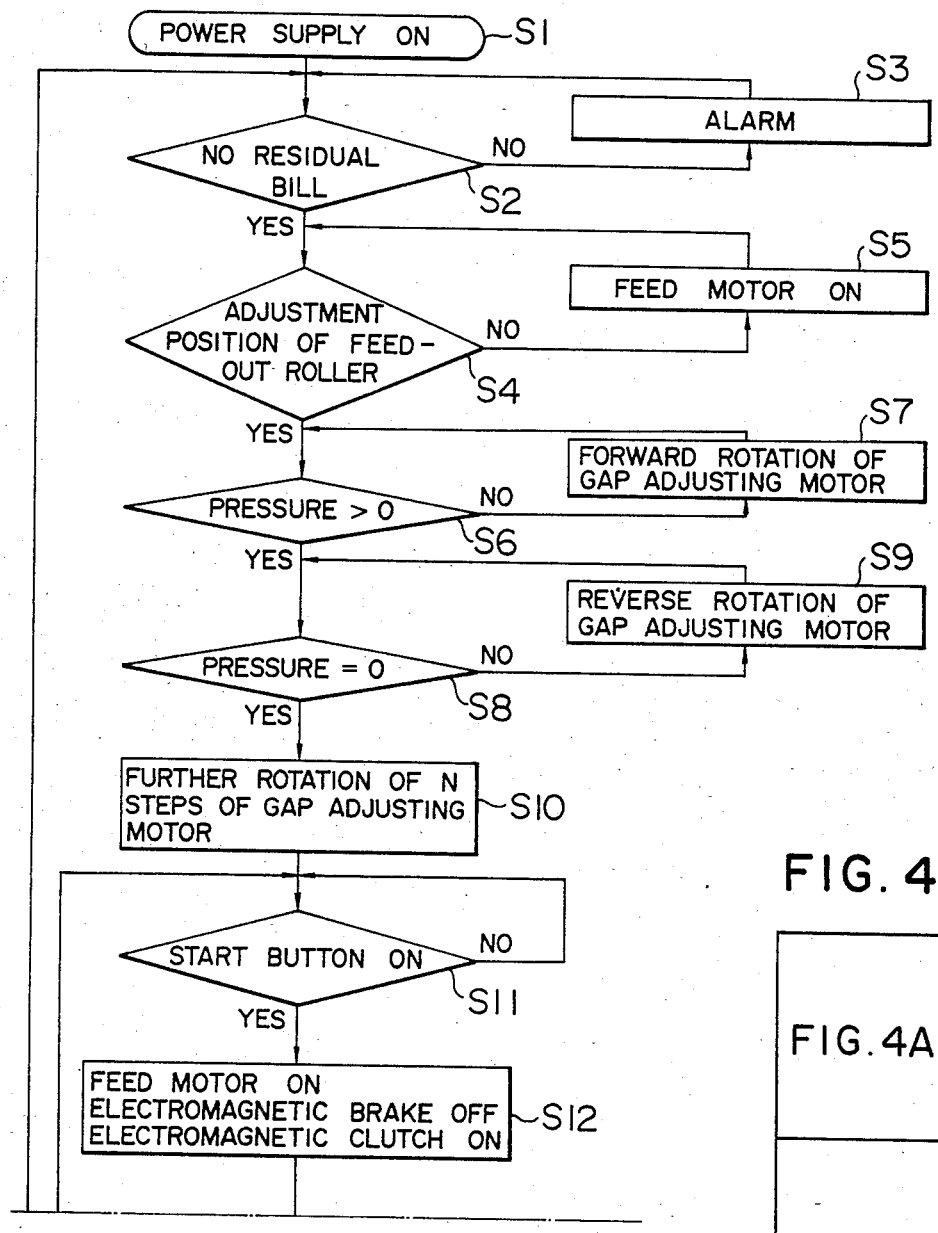
FIGS. 4A and 4B are flow charts illustrating the operations of the control circuit.
Figure 4:
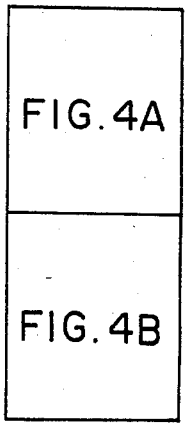
Figure 4B:
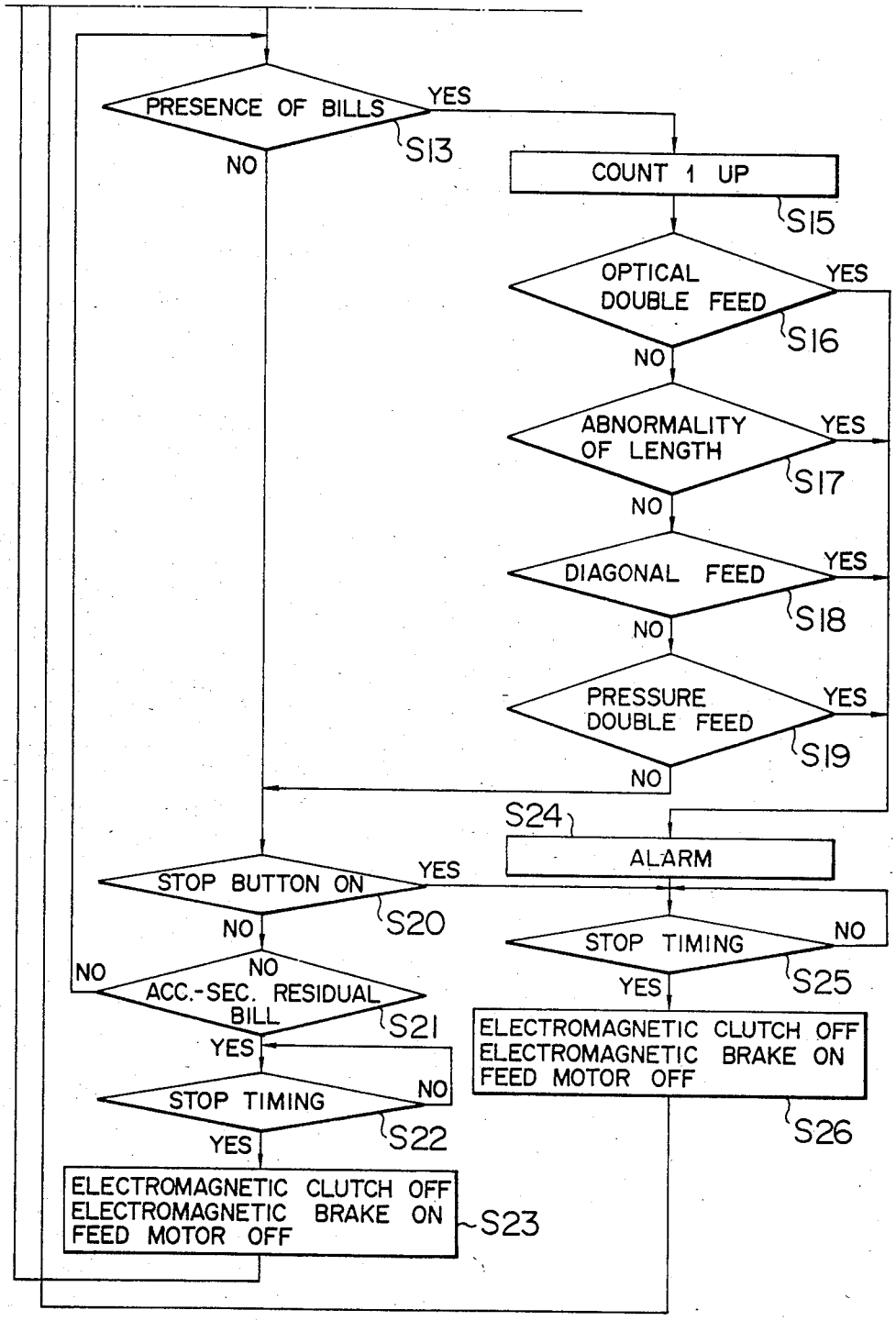

Referring now to FIG. 3, description will be made of a control circuit which adjusts the distance of the gap 9 by controlling the gap adjusting unit 13 on the basis of the results detected by the above sensors, or which controls the feeding out of the bills.

The control circuit is basically constituted by a central processing unit (CPU) 24, a read only memory (ROM) 25 and a random access memory (RAM) 26. The CPU 24, ROM 25 and RAM 26 are connected through an input side I/O port 28 to the pressure sensor 12, the stop position detecting sensor 15, the adjustment position detecting sensor 16 the accommodating-section residual bill detecting sensor 21A, the separating-section residual bill detecting sensor 22A, the counting sensor 23A and a start/stop button 27 for issuing an instruction for starting or stopping the feeding out of bills. The CPU 24, ROM 25 and RAM 26 are connected through an output side I/O port 29 to the gap adjusting unit 13, the electromagnetic brake 18, the field motor 19, and the electromagnetic clutch 20.

Next, description will be made of the operation of the aforementioned control circuit with reference to the flow chart shown in FIG. 4. In the description given below, Sn indicates an n-th step (Step n).

S1: power supply is turned on,

S2: whether or not bills remain in the gap 9, i.e., the presence of residual bill detecting signal of the separating-section residual bill detecting sensor 22A is detected. In the case of NO (where bills 3 remain), an alarm is issued (S3), while in the case of YES, the operation proceeds to the next step.

S4: Jugdment is made as to whether or not the feed-out roller 5 is in the adjustment position where the friction members 6 and 11 are opposed to each other, as shown in FIG. 2, i.e., whether or not the actuator 17*a* of the sensor actuating plate 17 is actuating the adjustment position detecting sensor 16. In the case of NO, the feed motor 19 is operated to cause the feed-out roller 5 to rotate up to the adjustment position (S5), while in the case of YES, the operation proceeds to the next step.

S6: Judgment is made as to whether or not the friction members 6 and 11 are in contact with each other, i.e., whether or not the pressure sensor 12 issues a detecting signal representative of "pressure $P>0$". In the case of NO, the pulse motor of the gap adjusting unit 13 is rotated forwardly ("forward rotation" means the direction of rotation which makes the gap narrow) to increase the contact pressure between the friction members 6 and 11. In the case of YES, the operation proceeds to the following step.

S8: Judgment is made as to whether or not the pressure detecting signal of the pressure sensor 12 is in the state of $P=0$. In the case of NO, the pulse motor of the gap adjusting unit 13 is rotated reversely (S9), while in the case of YES, the operation proceeds to the next step.

S10: The pulse motor of the gap adjusting unit 13 is further rotated reversely over N steps, and the size of the gap 9 between the friction members 6 and 11 is set to a predetermined value, i.e., a value which allows one bill to pass through the gap. The number of steps N representative of the quantity of reverse rotation is obtained in advance by carrying out experiments on the separation of bills and is stored in RAM 26 as set data.

After the gap 9 between the feed-out roller 5 and the friction block 8 is adjusted by the operations of S1 through S10, a bill feeding out operation is carried out.

S11: On condition that the start button 27 has been depressed, the operation proceeds to the next step.

S12: The electromagnetic brake 18 is turned off (in the open state), and at the same time, the electromagnetic clutch 20 is turned ON (in the connected state). Furthermore, when the feed motor 19 is rotated, the feed-out roller 5 is rotated to pull bills in, one by one.

S13: Judgment is made as to whether or not there are bills in the position of the sensor 23A. In the case of YES, the total count of the bills counted is increased by one for each count (S14). Judgment is made as to the presence of abnormalities with respect to the following respective cases (S16–S19): the optical double feed detection of the bills counted (detection of double feed by means of light beam transmittance), detection of abnormalities in the length (detection of double feed from the fact that the length of overlapping bills becomes longer than that of one bill), detection of diagonal feed, and pressure double feed detection (detection of double feed utilizing a pressure differential as between the case where one bill is fed into the gap 9 and the case where two or more bills are fed in). In a case where all of these cases fall under NO (when there are no abnormalities), the operation proceeds to S20, which will be described later, as in the case where the judgment in S13 is NO. In the case that any of S16–S19 is YES (when there are abnormalities), the operation proceeds to the flow of alarm operations (S24–S26), which will be described later.

S20: Judgment is made as to whether or nor the stop button 27 has been depressed. If depressed, the operation proceeds to S25, which will be described later. If not depressed, the operation proceeds to S21.

S21: Judgment is made as to whether or not there remain bills inside the bill accommodating section 1. In the case of NO (when bills remain), the operation returns to above-described S13. When bills do not remain (in the case of YES), the operation proceeds to the next step.

S22: The feed-out roller 5 rotates to its stop position i.e., to a position in which the starting end portion (the lower end portion in FIG. 2) of the friction member 6 is located in the vicinity of the feed-out port 7. On the condition that the stop position detecting sensor 15 is actuated by the actuator 17*a*, the operation proceeds to the next step.

S23: The feed motor 19 is stopped, and, at the same time, the electromagnetic clutch 20 is turned OFF so as to set the electromagnetic brake 18 in the braking condition. This stops the feed-out roller 5 at its stopping position, and then the operation returns to S2.

Next, description will be made of alarm operations in S24 to S26.

S24: In case where it is judged in any of the steps of S16 to S26 that abnormalities are present, an alarm is issued.

S25: On condition that the stop timing has been set, i.e., the stop position detecting sensor 15 has been actuated by the actuator 17*a*, the operation proceeds to the next step.

S26: The feed motor 19 is stopped and, at the same time, the electromagnetic clutch 20 is released so as to actuate the electromagnetic brake 18. Then, when the feed-out roller 6 stops, the next counting operation becomes ready.

When the operation stops after going through these steps S24 to S26, bills are often jammed between the feed-out roller 5 and the friction block 8. Since it is not desirable to make adjustment of the gap 9 in such a condition, the operation returns immediately to S11 without making adjustment of the gap 9.

The arrangement of the apparatus according to the present invention is not be restricted to the aforementioned embodiment. For instance, it is possible to adopt a system whereby the gap adjustment can be effected as desired by using an adjustment instructing switch or the like instead of a system of adjusting the gap immediately after turning on the power. Or it is also possible to adopt a system whereby adjustment is effected automatically by issuing an instruction for adjustment every time a fixed number of bills are fed out after adding up the number of bills fed out.

As has been explained, according to the invention, a friction member for separating bills one by one by applying friction force to bills passing through a gap between a feed-out roller and a friction block is provided with a pressure sensor for detecting the contact pressure between the friction member and the feed-out roller. The friction member is moved on the basis of the detection data of this pressure sensor. As a result, the apparatus according to this invention has an effect that the gap between the friction member and the feed-out roller can be kept at an optimum condition without being affected by wear of the friction member.

What is claimed is:

1. A bill feeding apparatus which separates and feeds bills, one at a time, from a stack of bills positioned in a bill handling machine, and which comprises:

(a) a feed-out roller for feeding out the bills by engaging with one surface of the bills, (b) a friction member having a gap for the passage of bills between the friction member and the feed-out roller and separating the bills, one at a time, by applying friction force to the other surface of the bills from the friction member, (c) a pressure sensor for detecting pressure acting on the friction member to generate a pressure signal, (d) a gap adjusting mechanism for adjusting the gap between the friction member and the feed-out roller by moving the friction member, and (e) a control circuit means for controlling the gap adjusting mechanism to adjust the gap on the basis of the pressure signal from the pressure sensor so that the size of the gap is first set to be zero by sensing when the pressure sensor first provides a pressure signal output as the gap is narrowed and the gap then is increased up to a predetermined value by moving the friction member relative to the feed-out roller in an initialization mode prior to feeding of the bills.

2. An apparatus as set forth in claim 1 wherein in a feeding mode the pressure signal is used to detect double-feeding of the bills.

3. An apparatus as set forth in claim 1 including residual bill detecting means for detecting the presence of a bill in the gap.

4. An apparatus as set forth in claim 3 including counting means for counting the number of bills that pass from the gap.

5. An apparatus as set forth in claim 4 wherein said feed-out roller includes a peripheral friction surface secured thereto over a portion of the peripheral surface thereof and said apparatus includes position sensing means for sensing the angular position of said peripheral friction surface relative to said friction member.

* * * * *